US005502347A

United States Patent [19]

Dworsky et al.

[11] Patent Number: 5,502,347

[45] Date of Patent: Mar. 26, 1996

[54] ELECTRON SOURCE

[75] Inventors: Lawrence N. Dworsky; James E. Jaskie, both of Scottsdale, Ariz.

[73] Assignee: Motorola, Schaumburg, Ill.

[21] Appl. No.: 319,403

[22] Filed: Oct. 6, 1994

[51] Int. Cl.[6] ..... H01J 1/02

[52] U.S. Cl. ..... 313/309; 313/336; 313/351

[58] Field of Search ..... 313/309, 336, 313/351, 495, 310

[56] References Cited

U.S. PATENT DOCUMENTS 3,904,994 9/1975 Bates et al. ..... 315/3.5

5,194,780 3/1993 Meyer ..... 313/309

5,283,500 1/1994 Kochanski ..... 313/309

*Primary Examiner*—Sandra L. O'Shea

*Assistant Examiner*—Vip Patel

*Attorney, Agent, or Firm*—Robert F. Hightower

[57] ABSTRACT

A display device (10) positions emitters (34,36,37,38,41,42, 43,44,46, and 47) equidistant from a meander conductor (26). The meander conductor (26) is formed with a pattern that facilitates such equidistant placement. The equidistant placement results in approximately equal ballast resistor values for each emitter (34,36,37,38,41,42,43,44,46, and 47).

12 Claims, 3 Drawing Sheets

10

80

ELECTRON SOURCE

BACKGROUND OF THE INVENTION

The present invention relates, in general, to electron emission display devices, and more particularly, to a novel electron emission source.

Field Emission Devices (FEDs) are well known in the art and are commonly employed for a broad range of applications including image display devices. Such FEDs typically utilize a matrix of row and column conductors that are used to stimulate electron emission from emitters connected to the column conductors. Also, a ballast resistor typically is used in series between each emitter and the corresponding column conductor. One method of forming such ballast resistors includes applying a resistive layer on a substrate. On top of the resistive layer the column conductor is formed with a grating-like conductor structure. Between cross-members of the conductor's grating-like structure, mesh type openings expose portions of the resistive layer. Emitters are positioned within the meshes on the resistive layer. Such grating-like conductor structures and meshes are described in U.S. Pat. No. 5,194,780 issued to Robert Meyer on Mar. 16, 1993. As described in the above referenced patent, within each mesh a matrix of approximately 36 emitters is formed in order to emit electrons.

One notable disadvantage of such prior art FEDs is the distance of each emitter from the conductor. Within each mesh, current flows from the conductor, through the resistive material to the emitters. Because the distance of each emitter from the conductor varies, the resistance between the conductor and each emitter also varies, thus, the current to each emitter also varies. In some cases, interior emitters may be sufficiently far from a conductor to prevent electron emission. Consequently, it is difficult to accurately control emitters and the corresponding image formed by electrons emitted from the emitters.

Accordingly, it is desirable to have an electron source having emitters that are not at different distances from a column conductor, that do not have different ballast resistor values, and that do not emit different currents.

DETAILED DESCRIPTION OF THE DRAWINGS

Figure 1:
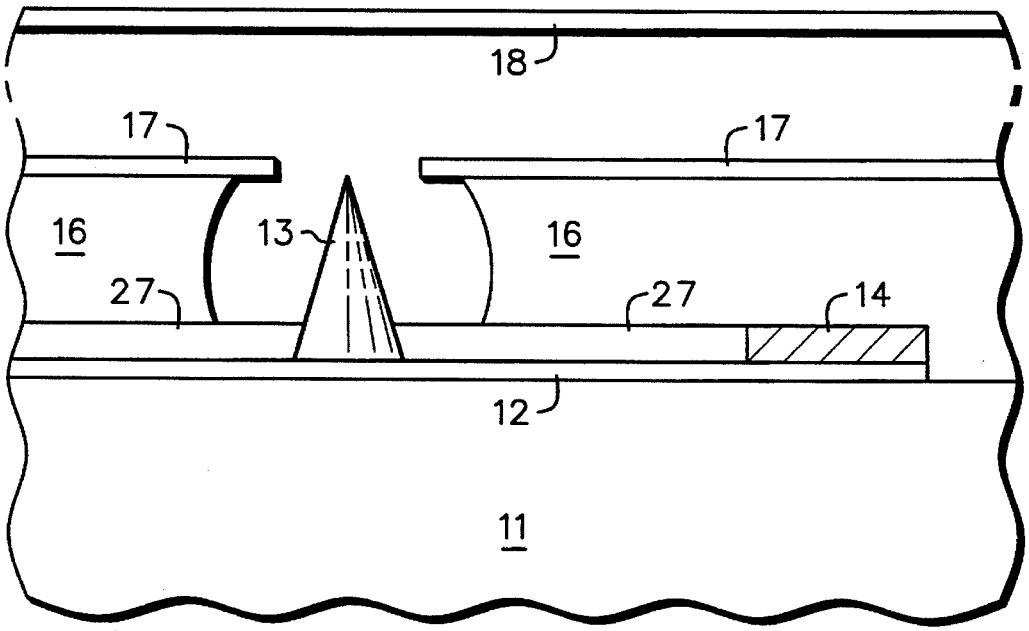
FIG. 1 illustrates an enlarged cross-sectional portion of a display device in accordance with the present invention.

FIG. 1 schematically illustrates an enlarged cross-sectional portion of a field emission display device 10 that has a novel ballast resistor scheme. Device 10 includes a substrate 11 on which other portions of device 10 are formed. Substrate 11 typically is an insulating or semi-insulating material, for example, silicon having a dielectric layer or glass. In the preferred embodiment, substrate 11 is glass. A resistive layer 12 generally is formed on a surface of substrate 11. As will be more apparent hereinafter in the subsequent descriptions, a novel cathode conductor pattern is formed thereon to facilitate utilizing layer 12 as a novel ballast resistor that has substantially equal resistor values for each emitter. This novel cathode conductor pattern includes a conductor strip 14 and a meander conductor pattern that has a first meander conductor section 27 on layer 12. As will be more apparent hereinafter, FIG. 1 illustrates only a portion of the meander conductor pattern and conductor strip 14. Device 10 also includes a cathode or electron emitter 13 that is on layer 12 and is utilized to emit electrons that are gathered by an anode 18 which is distally disposed from emitter 13. The surface of anode 18 facing emitter 13 typically is coated with a phosphor in order to produce an image or display as electrons strike anode 18. A dielectric layer 16 is utilized to electrically isolate an extraction grid or gate 17 from substrate 11, layer 12, conductor strip 14, and section 27.

Figure 2:
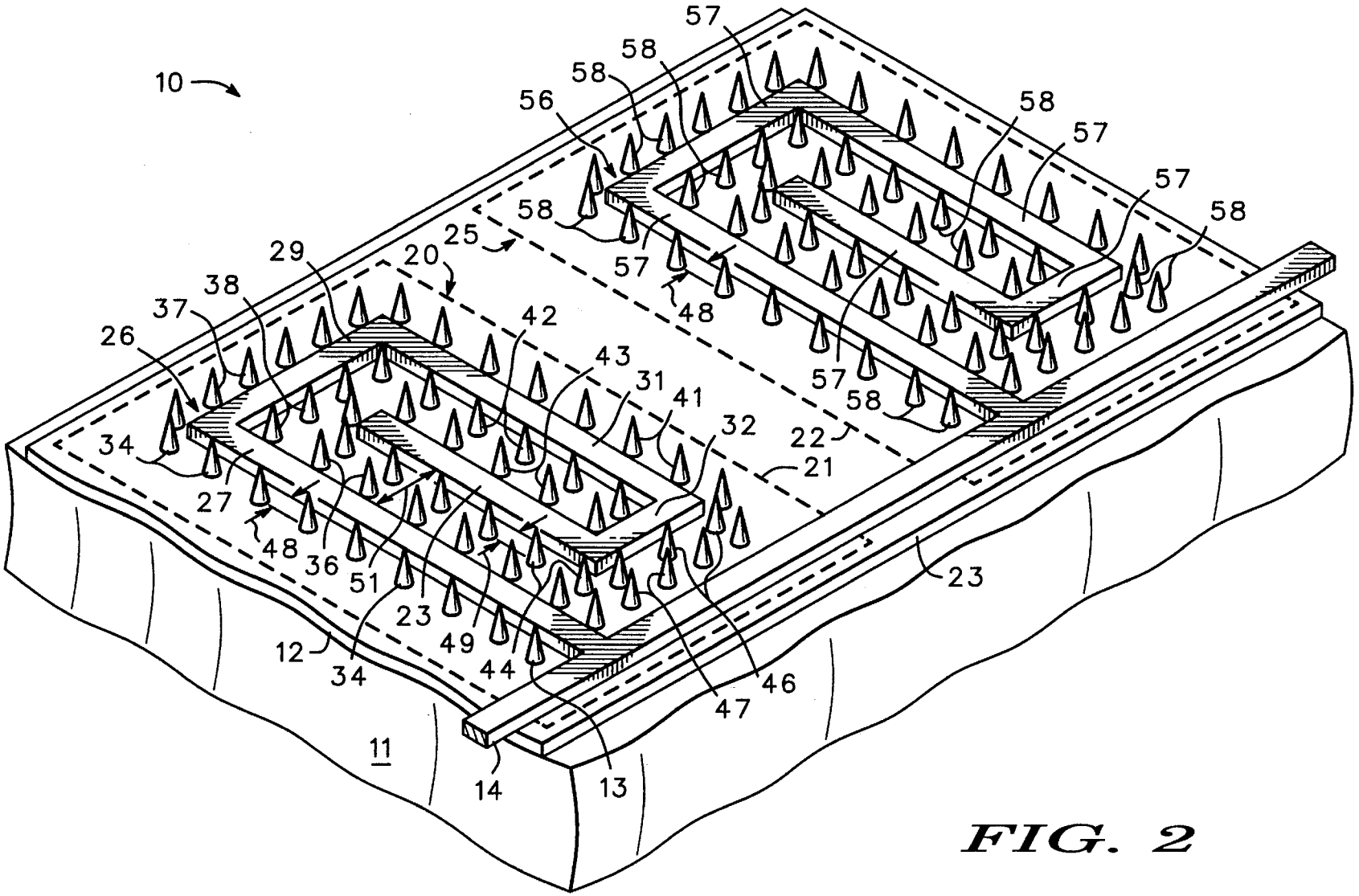
FIG. 2 illustrates an enlarged perspective view of a portion of an electron source in accordance with the present invention.

FIG. 2 schematically illustrates an enlarged perspective view of a portion of device 10 shown in FIG. 1. Elements of FIG. 2 that are the same as FIG. 1 have the same reference numerals. Device 10 (FIG. 1) includes a plurality of electron sources including a first electron source 20 and a second electron source 25. Sources 20 and 25 are respectively formed in a first pixel area 21 and a second pixel area 22, illustrated by dashed boxes, on resistive layer 12. A plurality of pixel areas such as areas 21 and 22 generally are utilized to illuminate an individual pixel of a display although a single pixel area can be used. Typically, each pixel area is on a portion of layer 12 underlying each gate 17 of device 10. Conductor strip 14 is formed along a first long edge 23 of layer 12 and is utilized to connect the plurality of electron sources into a column. The column is used for applying a voltage to electron sources 20 and 25. Use of column conductors for applying such voltages is well known to those skilled in the art. Projecting laterally from conductor strip 14 within pixel area 21 is a first meander pattern conductor 26 that is formed in a shape that facilitates placing a plurality of emitters 34, 36, 37, 38, 41, 42, 43, 44, 46, and 47 such that all emitters are positioned the same distance from meander pattern conductor 26, that is, each emitter is equidistant from the closest section of conductor 26. Conductor 26 can have any of a variety of patterns that facilitate placing all emitters at the same distance from the closest section of conductor 26. For example, conductor 26 may be a circular spiral, a rectangular spiral-like pattern, a square spiral-like pattern, or a series of finger-like elements projecting from conductor strip 14 into pixel area 21.

In the preferred embodiment, conductor 26 is a rectangular spiral-like pattern because it is believed that such a pattern facilitates forming the highest density of emitters within pixel area 21. In this preferred embodiment, the rectangular spiral-like pattern is formed by a plurality of straight sections 33, 32, 31, 29, and 27 that are placed a right angles to one another in order to form the rectangular spiral-like pattern. Adjacent each section, emitters are positioned on layer 12 so that each emitter is the same distance from its corresponding section of conductor 26. For example, each emitter of plurality of emitters 34 and 36 is a distance 48, illustrated by an arrow, from section 27. Additionally, emitters 37 and 38 are also distance 48 from section 29 while plurality of emitters 41 and 42 are distance 48 from section 31, plurality of emitters 43 and 44 are distance 48 from section 33, and plurality of emitters 46 and 47 are distance 48 from section 32 and conductor strip 14, respectively. In the preferred embodiment, distance 48 is approximately five to twenty microns in order to prevent breakdown between the meander conductor and the emitters, while the width of conductor 26 is less than approximately ten microns.

Current flows from sections 27, 29, 31, 32, and 33 through layer 12 to each emitter. Because each emitter is the same distance from the corresponding section of conductor 26 the current for each emitter passes through the same length of the material used for layer 12, thus, the value of the ballast resistor for each emitter is substantially identical. In the preferred embodiment, layer 12 is formed from doped silicon approximately 0.5 to 1.5 microns thick and having a resistivity of approximately $1\times10^3$ to $1\times10^9$ ohm-cm. Therefore each emitter has a substantially identical ballast resistor, thus, the amount of current flowing through each emitter is substantially identical and the intensity of the image created by each emitter is substantially identical. Consequently, spacing emitters equidistant from conductor 26 facilitates forming a uniform display pattern for each pixel of display 10 (FIG. 1).

Source 25 is formed within second pixel area 22 and is similar to source 20. Within area 22 is a second meander pattern conductor 56 that is similar to conductor 26. Conductor 56 includes sections 57 which are similar to respective sections 33, 32, 31, 29, and 27. A plurality of emitters 58 are positioned along sections 57 so that each emitter is substantially equidistant from its respective section of conductor 56, e.g. distance 48.

Although FIG. 2 illustrates a single resistive layer 12, a single strip conductor strip 14, and two conductors 26 and 56, it is understood that more than two meander pattern conductors may be interconnected by conductor strip 14. Additionally, device 10 may employ a plurality of columns wherein each column has a resistive layer 12, a conductor strip 14, a plurality of meander pattern conductors 26, and a plurality of emitters that are equidistant from the meander pattern conductor.

Figure 3:
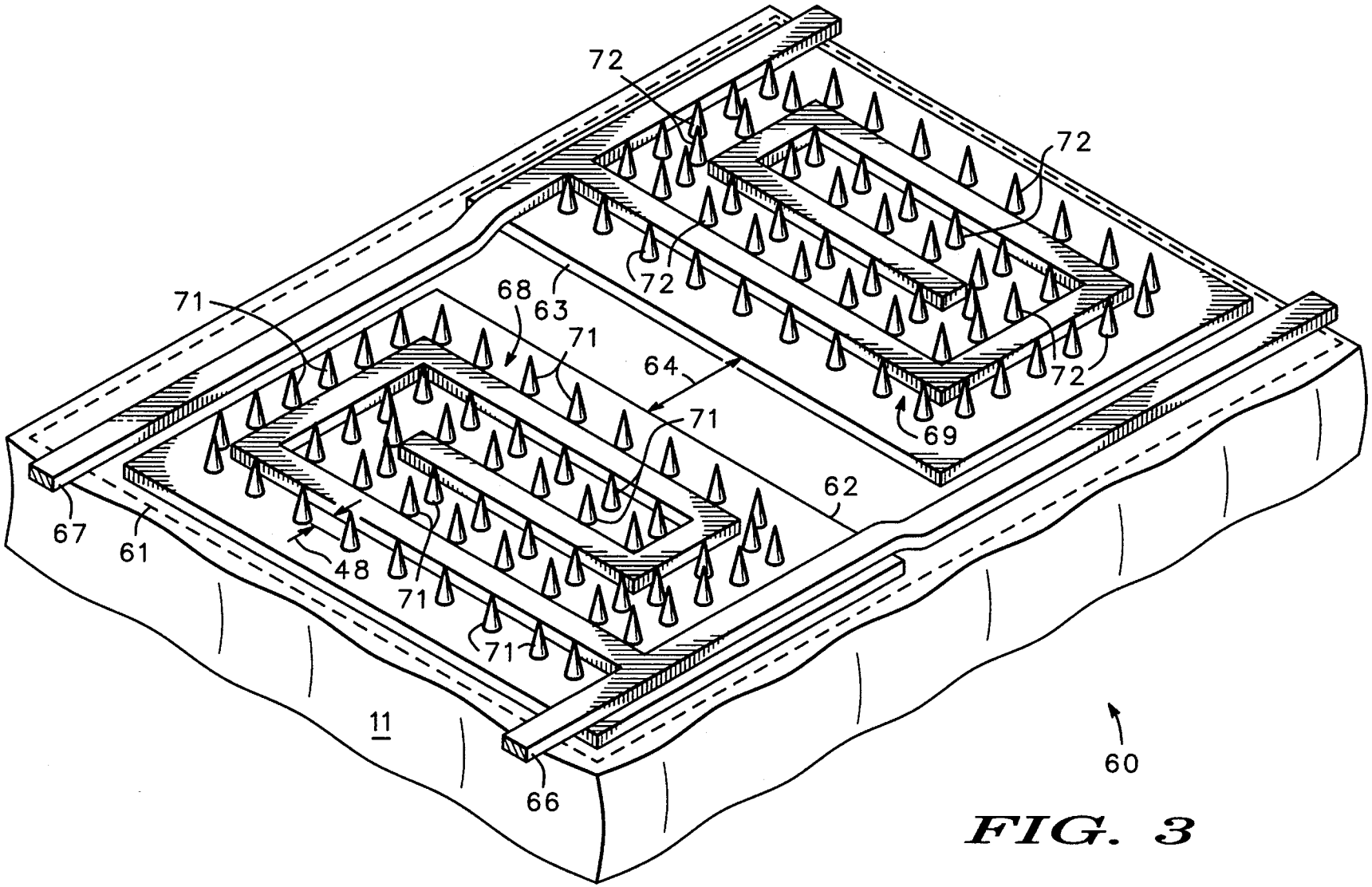
FIG. 3 illustrates an alternate embodiment of an electron source in accordance with the present invention.

FIG. 3 illustrates an alternate embodiment of an electron source 60 that has a split column conductor pattern. Elements of FIG. 3 that are the same as FIG. 1 have the same reference numbers. Often, pin holes in dielectric layer 16 (FIG. 1) result in an electrical short circuit between gate 17 and conductor strip 14. Such shorts prevent creating a voltage differential between gate 17 and emitter 13 thereby rendering a particular column of device 10 inoperable. As will be see hereinafter, source 60 utilizes a split conductor, two electrically isolated conductors with electrically isolated meander pattern conductors, which permits one portion of source 60 to be energized when the opposite portion is electrically shorted or otherwise disabled.

Source 60 generally is formed within a pixel area 61, illustrated by a dashed box. A display may utilize a plurality of pixel areas 61 to illuminate a single pixel of the display. Conductor strip 66 runs along one edge of pixel area 61 while conductor strip 67 runs along an opposite edge of area 61. Typically, area 61 is formed where gate 17 overlies strips 66 and 67. Within pixel area 61 is a first resistive section 62 and a second resistive section 63 that are electrically isolated. Sections 62 and 63 can be formed by applying a continuous resistive layer to substrate 11, and then etching through the resistive layer to form separated sections 62 and 63. As shown in FIG. 3, strip 66 overlaps one side of section 62 so that strip 66 electrically contacts section 62 but is not electrically connected to section 63. Similarly, strip 67 overlaps a side of section 63 so that strip 67 is electrically connected to section 63 but is not electrically connected to section 62. A first meander pattern conductor 68 is formed on section 62 and is electrically connected to strip 66 while a second meander pattern conductor 69 is formed on section 63 and is electrically connected to strip 67. Conductors 68 and 69 are each similar to conductor 26 shown in FIG. 2. Additionally, source 60 includes a first plurality of emitters 71 that are formed on section 62 so that each emitter is equidistant from the corresponding section of conductor 68. Similarly, a plurality of emitters 72 are formed on section 63 so that each emitter is equidistant from the corresponding section of conductor 69. Consequently, conductor 68 and emitters 71 function similarly to conductor 26 and the emitters surrounding conductor 26. Also, conductor 69 and emitters 72 function similarly to conductor 26 and the corresponding emitters surrounding conductor 26. A distance 64 separates section 62 from section 63 in order to prevent electrically isolate sections 62 and 63. I the preferred embodiment, distance 64 is approximately one to three microns in order to prevent breakdown between sections 62 and 63. Because strip 67, conductor 69 and emitters 72 are electrically isolated from strip 66, conductor 68, and emitters 71, each section functions independently. Thus, if there is a short between strip 67 and gate 17, emitters 71 are still functional and can be energized through strip 66. Therefore, electron source 60 facilitates forming an image on anode 18 (FIG. 1) even if there is a short between gate 17 and a column conductor.

Figure 4:
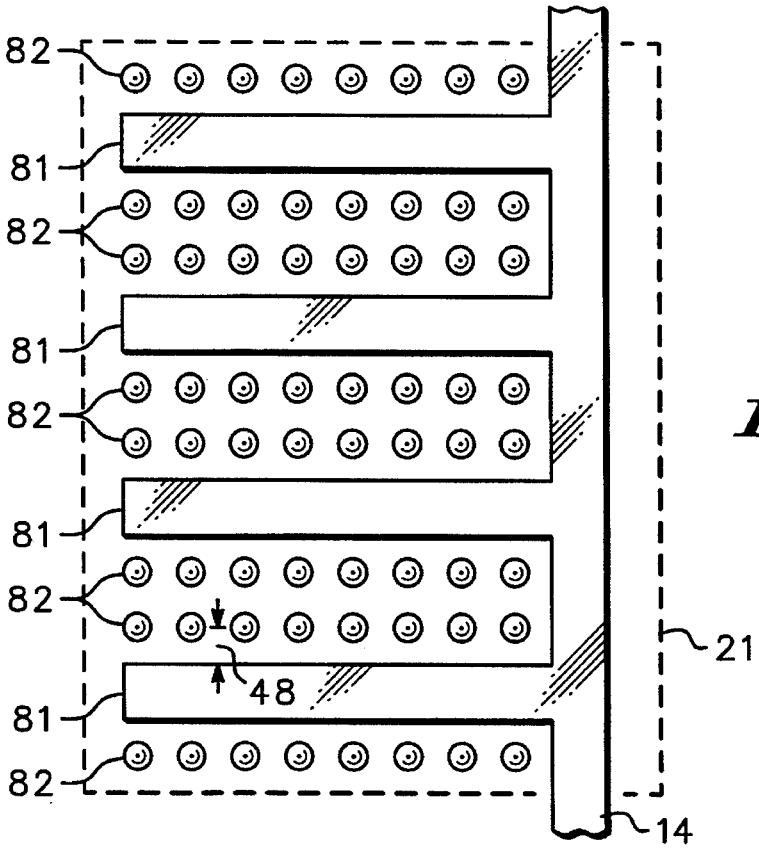
FIG. 4 illustrates an alternate embodiment of a meander pattern conductor in accordance with the present invention.

FIG. 4 illustrates an enlarged overhead view of a portion of an alternate embodiment of a meander pattern conductor 80 that functions similarly to conductor 26 shown in FIG. 2. Elements of FIG. 4 having the same reference numbers as FIG. 2 are the same. Conductor 80 has a plurality of digitated or finger-like conductor sections 81 that function similarly to sections 33,32,31,29, and 27 shown in FIG. 2. Emitters 82 are positioned to be equidistant from the corresponding section 81.

By now it should be appreciated that there has been provided a novel electron source that equalizes the intensity of images formed by electron sources of the display device. By utilizing a meander pattern conductor, emitters can be positioned so that each emitter is equidistant from the meander conductor. Because of the equidistant spacing, the ballast resistor of each emitter has substantially the same value, thus, each emitter emits substantially the same electron density. Accordingly, a display device utilizing the electron source has substantially the same electron emission for each emitter. Additionally, utilizing an electron source with a split conductor allows forming images even if one conductor is electrically shorted or inoperative. Thus, the display remains usable thereby reducing display manufacturing costs.

We claim:

1. An electron source comprising:

a substrate;

a resistive layer on the substrate wherein a portion of the resistive layer forms a first pixel area;

a conductor strip on the resistive layer, the conductor strip positioned adjacent a first long side of the resistive layer;

a first meander conductor on the resistive layer and within the first pixel area wherein the first meander conductor projects from the conductor strip; and a first plurality of emitters on the resistive layer wherein each emitter is substantially equidistant from the first meander conductor.

2. The source of claim 1 wherein the first meander conductor is substantially a rectangular spiral.

3. The source of claim 1 wherein the first meander conductor is substantially a circular spiral.

4. The source of claim 1 wherein the resistive layer has a resistivity of approximately $1\times10^3$ to $1\times10^9$ ohm-cm.

5. The source of claim 1 further including:

a second pixel area on the resistive layer;

a second meander conductor on the resistive layer and within the second pixel area wherein the second meander conductor projects from the conductor strip; and a second plurality of emitters on the resistive layer wherein each emitter of the second plurality of emitters is substantially equidistant from the second meander conductor.

6. The source of claim 1 wherein the first meander conductor is a plurality of digitated projections from the conductor strip.

7. An electron source comprising:

a substrate;

a first resistive section on the substrate wherein a portion of the first resistive section forms a first pixel area;

a first conductor strip on the first resistive section, the first conductor strip positioned adjacent to a first side of the first resistive section;

a first meander conductor on the first resistive section and within the first pixel area wherein the first meander conductor projects from the first conductor strip;

a first plurality of emitters on the first resistive section wherein each emitter is substantially equidistant from the first meander conductor;

a second resistive section on the substrate wherein the second resistive section is electrically isolated from the first resistive section and from the first conductor strip and wherein a portion of the second resistive section forms a second pixel area;

a second conductor strip on the second resistive section, the second conductor strip positioned adjacent a side of the second resistive section;

a second meander conductor on the second resistive section and within the second pixel area wherein the second meander conductor projects from the second conductor strip; and a second plurality of emitters on the second resistive section wherein each emitter of the second plurality of emitters is substantially equidistant from the second meander conductor.

8. The source of claim 7 wherein the first and the second meander conductors each have a rectangular spiral-like shape.

9. The source of claim 7 wherein the first meander conductor is a digitated projection from the first conductor strip and the second meander conductor is a digitated projection from the second conductor strip.

10. A method of forming an electron source comprising:

positioning a plurality of emitters on a resistive layer wherein each emitter of the plurality of emitters is approximately equidistant from a conductor that is on the resistive layer for forming substantially equal resistance from the conductor to each emitter of the plurality of emitters.

11. The method of claim 10 wherein positioning the plurality of emitters includes positioning the plurality of emitters on the resistive layer so that each emitter of the plurality of emitters is approximately equidistant from a rectangular spiral-like conductor.

12. The method of claim 10 wherein positioning the plurality of emitters includes positioning the plurality of emitters on the resistive layer so that each emitter of the plurality of emitters is approximately equidistant from a digitated conductor.

* * * * *